US009103007B2

(12) United States Patent
Chen

(10) Patent No.: US 9,103,007 B2
(45) Date of Patent: Aug. 11, 2015

(54) ZINC-MODIFIED FERRITIC STAINLESS STEELS AND MANUFACTURING METHOD THEREOF

(71) Applicant: NATIONAL TSING HUA UNIVERSITY, Hsinchu (TW)

(72) Inventor: Swe-Kai Chen, Hsinchu (TW)

(73) Assignee: NATIONAL TSING HUA UNIVERSITY, Hsinchu (TW)

( * ) Notice: Subject to any disclaimer, the term of this patent is extended or adjusted under 35 U.S.C. 154(b) by 374 days.

(21) Appl. No.: 13/753,116

(22) Filed: Jan. 29, 2013

(65) Prior Publication Data

US 2014/0119976 A1 May 1, 2014

(30) Foreign Application Priority Data

Oct. 30, 2012 (TW) ..... 101140208 A

(51) Int. Cl.

| | |
|---|---|
| ***C21C 5/00*** | (2006.01) |
| ***C22C 33/00*** | (2006.01) |
| ***C22C 38/18*** | (2006.01) |
| ***C22C 38/20*** | (2006.01) |
| ***C21D 6/00*** | (2006.01) |

(52) U.S. Cl.

CPC ..... *C22C 33/00* (2013.01); *C21D 6/002* (2013.01); *C22C 38/18* (2013.01); *C22C 38/20* (2013.01)

(58) Field of Classification Search

CPC ..... C23C 38/20
USPC ..... 419/20
See application file for complete search history.

(56) References Cited

U.S. PATENT DOCUMENTS 2,228,600 A * 1/1941 Hardy ..... 419/39
6,391,253 B1 * 5/2002 Tochihara et al. ..... 420/35

FOREIGN PATENT DOCUMENTS

JP 2012162760 A * 8/2012

* cited by examiner

*Primary Examiner* — Jessee Roe
*Assistant Examiner* — Christopher Kessler
(74) *Attorney, Agent, or Firm* — Muncy, Geissler, Olds & Lowe, P.C.

(57) ABSTRACT

The present invention discloses zinc-modified ferritic stainless steels and a manufacturing method thereof. The chemical composition of the ferritic stainless steels comprises 14-16 wt % chromium, 0.001-4 wt % zinc, 0.001-0.02 wt % nitrogen, 0.003-0.015 wt % carbon and the remaining of weight percentage of the composition is iron. By adding zinc into the composition, the ferritic stainless steels of the present invention have stronger capacity of corrosion resistance and lower manufacturing cost, as compared to the conventional stainless steels.

12 Claims, 1 Drawing Sheet

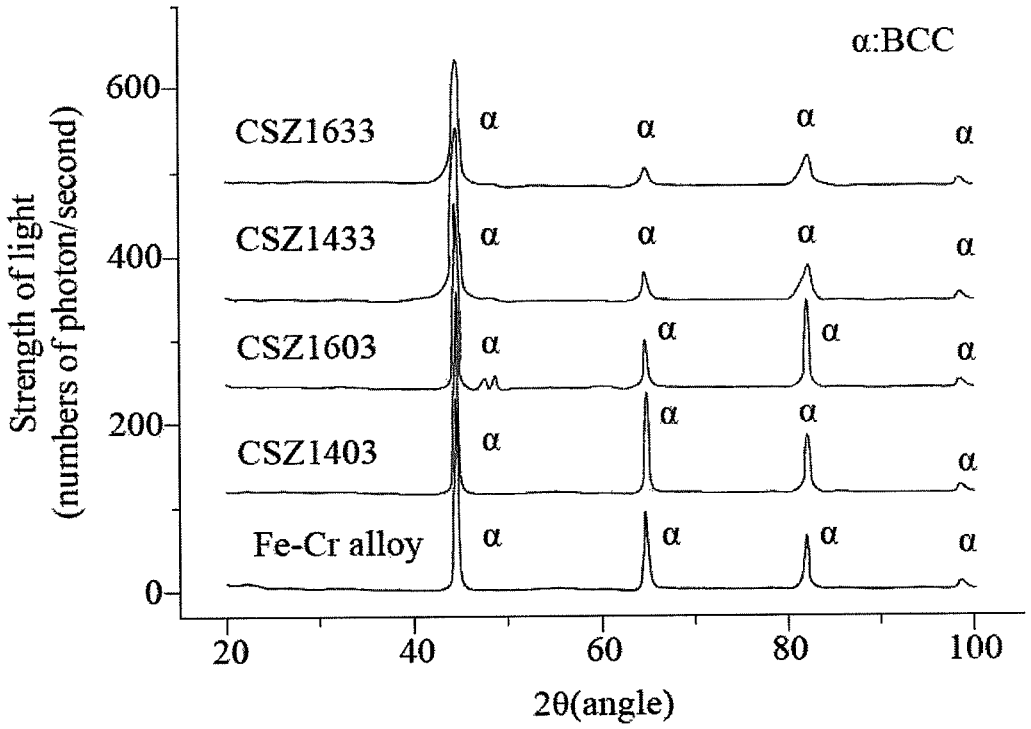
α:BCC
CSZ1633
CSZ1433
CSZ1603
CSZ1403
Fe-Cr alloy
α
Strength of light
(numbers of photon/second)
600
400
200
0
20
40
60
80
100
2θ(angle)

ZINC-MODIFIED FERRITIC STAINLESS STEELS AND MANUFACTURING METHOD THEREOF

CROSS-REFERENCE TO RELATED APPLICATION

This application claims the benefit of Taiwan Patent Application No. 101140208, filed on Oct. 30, 2012, in the Taiwan Intellectual Property Office, the disclosure of which is incorporated herein in its entirety by reference.

BACKGROUND OF THE INVENTION

1. Field of the Invention

The present invention relates to a zinc-modified ferritic stainless steel and manufacturing method thereof, in particular a zinc-modified ferritic stainless steel with a decent capacity of corrosion resistance and manufacturing method thereof. Its chemical components (by weight percent, wt %) comprise chromium being in a range of 14-16 weight percent, zinc being in a range of 0.001-4 weight percent, nitrogen being in a range of 0.001-0.02 weight percent, carbon being in a range of 0.003-0.015 weight percent, and rest of weight percentage of compositions being iron and a few amount of inevitable impurities.

2. Description of the Related Art

Currently, the commercial stainless steels could be classified as one of the four types: austenite, ferrite, martensite and precipitation-hardening. Based on the theory, chromium should occupy at least 12 weight percent of the components in the whole types of stainless steels to form a complete protective film for achieving the stainless effect.

In the stainless steels mentioned above, because the non-magnetic 300 series of austenitic stainless steels contain a better working capacity and a corrosion resistance, the quantity of their usage is the largest and they are broadly applied in the fields of staple merchandise, machine parts of food and medical tools. A common 300 series of austenitic stainless steels comprise nickel in the range of 6-12 weight percent, and nickel is an important element for stabilizing the austenitic stainless steels which are easily worked and improving the capacity of corrosion resistance. However, among the main elements including iron, chromium and nickel composing the stainless steels, the price of nickel is the highest and it fluctuates extremely. Additionally, nickel is one of the strategic materials. Therefore, in order to reduce the amount of nickel applied to the stainless steels, the 200 series of austenitic stainless steels with few amount of nickel in content gradually draw lots of attention from the manufacturers of the stainless steels in recent years. These stainless steels are made of three cheap elements including manganese, nitrogen and carbon to replace parts of nickel in content. Generally, the experience shows 1 weight percent of nickel is replaced by 2 weight percent of manganese. For example, adding chromium in a range of 16-18 weight percent, manganese in a range of 5.5-7.5 weight percent, nickel in a range of 3.5-5.5 weight percent, carbon below 0.15 weight percent and nitrogen below 0.25 weight percent into iron for steel number AISI 201; adding chromium in a range of 17-19 weight percent, manganese in a range of 7.5-10 weight percent, nickel in a range of 4-6 weight percent, carbon below 0.15 weight percent and nitrogen below 0.25 weight percent into iron for steel number AISI 202; adding chromium in a range of 15-17 weight percent, manganese in a range of 7-9 weight percent, nickel in a range of 1.5-3 weight percent, carbon below 0.03 weight percent and nitrogen in a range of 0.15-0.3 weight percent into iron for steel number AISI 204; adding chromium in a range of 16.5-18 weight percent, manganese in a range of 14-15.5 weight percent, nickel in a range of 1-1.75 weight percent, carbon below 0.25 weight percent and nitrogen below 0.4 weight percent into iron for steel number AISI 205. Only the steel numbers mentioned above in the 200 series of stainless steels should be added with nickel for stabilizing the austenitic iron. And the magnetic series of ferritic stainless steel within the other four types, for example, AISI 430, although their contents do not contain any nickel, the corrosion resistance of them is poor so that they are limited in applications.

Therefore, in order to achieve the goal of manufacturing the series of austenitic stainless steels without nickel in content, the manufacturer can try the method of adding manganese, nitrogen or carbon into the content again or other technique such as reducing the content of chromium and so on to achieve the goal of manufacturing the stainless steels without nickel. However, in prior art, if there is too much content of manganese or carbon in the stainless steel, adverse effects are easily generated in hot work or the capacity of resisting corrosion of the stainless steel. Therefore, when using manganese or carbon to replace nickel, the amount thereof should be limited.

Currently, the commercial series of austenitic stainless steels without nickel in content such as steel number UNSS 28200, adding chromium in a range of 17-19 weight percent, manganese in a range of 17-19 weight percent, copper in a range of 0.5-1.5 weight percent, molybdenum in a range of 0.5-1.5 weight percent, nitrogen in a range of 0.4-0.6 weight percent, and carbon below 0.15 weight percent into iron for it. This kind of stainless steel contains chromium much more. Although adding elements such as molybdenum, manganese and so on could achieve the goal of manufacturing the series of austenitic stainless steels without nickel in content; these elements have the shortcoming of high price.

Therefore, based on the aforementioned problems in the prior art technique, the objective of the present invention is to provide a novel zinc-modified ferritic stainless steel corresponding to the basic requirement of keeping its high capacity of corrosion resistance together with lowering the addition of elements with high price such as chromium, manganese, molybdenum, and so on for reducing the production cost of the stainless steel with high capacity of corrosion resistance.

SUMMARY OF THE INVENTION

Based on the aforementioned problems in the prior art technique, the objective of the present invention is to provide a novel zinc-modified ferritic stainless steel to solve the problem of high production cost of the austenitic stainless steels because of adding the elements with high price such as nickel, molybdenum, manganese, and so on into the manufacturing process.

According to one objective of the present invention, a zinc-modified ferritic stainless steel with preferable components is provided comprising carbon in a range of 0.003-0.015 weight percent, nitrogen in a range of 0.001-0.02 weight percent, chromium in a range of 14-16 weight percent, zinc in a range of 0.001-4 weight percent, and the rest of weight percentage of compositions being iron and a few amount of inevitable impurities.

According to another objective of the present invention, a zinc-modified ferritic stainless steel with preferable components is provided comprising carbon in a range of 0.003-0.015 weight percent, nitrogen in a range of 0.001-0.02 weight percent, chromium in a range of 14-16 weight percent, zinc in a range of 0.001-4 weight percent, tin in a range of 0.001-10 weight percent, and the rest of weight percentage of compositions being iron and a few amount of inevitable impurities.

According to the other objective of the present invention, a zinc-modified ferritic stainless steel with preferable components is provided comprising carbon in a range of 0.003-0.015 weight percent, nitrogen in a range of 0.001-0.02 weight percent, chromium in a range of 14-16 weight percent, zinc in a range of 0.001-4 weight percent, tin in a range of 0.001-10 weight percent, copper in a range of 0.001-0.05 weight percent, and the rest of weight percentage of compositions being iron and a few amount of inevitable impurities.

According to the other objective of the present invention, a manufacturing method of the zinc-modified ferritic stainless steel is provided and it is applied to manufacture a zinc-modified ferritic stainless steel, comprising the following steps of:

providing a test piece and proceeding a cold briquetting process;

putting the test piece into a mould after proceeding the cold briquetting process;

putting the mould into a furnace tube and sealing the furnace tube, and then withdrawing the air inside the furnace tube to make it under the condition of vacuum in reality;

injecting nitrogen into the vacuumed furnace tube to make it under the condition of positive pressure in reality;

then heating the furnace tube to keep the furnace tube maintaining a predetermined temperature within a predetermined time; and taking the test piece out from the mould and then performing a water quenching process.

wherein the compositions of the test piece comprise carbon, nitrogen, chromium, zinc, tin and copper to form the zinc-modified ferritic stainless steel.

A preferably predetermined temperature is in a range of 600° C. to 800° C.

A preferably predetermined time is in a range of 10 hours to 14 hours.

A preferably designed mould is to make zinc inside the test piece nonvolatile in order to improve recovery ratio of metal.

In summation of the description above, the zinc-modified ferritic stainless steel of the present invention includes the advantage as follows:

Through adding zinc which has high capacity of corrosion resistance instead of the elements such as nickel, manganese, and so on having not only high capacity of corrosion resistance but also high price to the manufacture of the austenitic stainless steels with high capacity of corrosion resistance in prior art, the production cost of the stainless steel with high capacity of corrosion resistance may be efficiently reduced.

BRIEF DESCRIPTION OF THE DRAWINGS

FIG. 1 is a schematic diagram of the zinc-modified ferritic stainless steel of the present invention.

DETAILED DESCRIPTION OF THE PREFERRED EMBODIMENTS

The technical contents and characteristics of the present invention will be apparent with the detailed description of a preferred embodiment accompanied with related drawing as follows. For simplicity, the same numerals are used for the same respective elements in the description of the following preferred embodiments and the illustration of the drawing.

The first preferred embodiment of the zinc-modified ferritic stainless steel of the present invention, it with preferable components comprises carbon in a range of 0.003-0.015 weight percent, nitrogen in a range of 0.001-0.02 weight percent, chromium in a range of 14-16 weight percent, zinc in a range of 0.001-4 weight percent, and the rest of weight percentage of compositions being iron and a few amount of inevitable impurities. Further analysis and explanation toward the characteristics, containing quantity and importance of each component in the zinc-modified ferritic stainless steel of the first preferred embodiment is as follows.

Carbon (C): carbon is a stable element for strengthening the austenitic stainless steel. Carbon could lower the containing quantity of the δ-ferritic stainless steel and improve the ability of hot work. In addition, carbon has the effect of reducing the containing quantity of nickel which is expensive, increases the stacking fault energy, and thus improves the characteristic of formation. If the containing quantity of carbon is too much, during the deep-drawing process of stainless steel, the strength of the induced strain of the martensitic stainless steel is increased and the stress strain of the residuals becomes high. Thus, these characteristics result in lowering the capacity of crack resistance. Furthermore, because the $Cr_{23}C_6$ carbide is precipitated to result in lowering the capacity of corrosion resistance when the stainless steel is annealed, the preferably containing quantity of carbon is limited in a range of 0.003-0.015 weight percent.

Nitrogen (N): If the containing quantity of nitrogen is too much and then that situation helps to reduce the containing quantity of the δ-ferritic stainless steel and increases yield strength of the steel twice that of the carbon, then it deteriorates the characteristics of formation. In addition, because strength is increased together with lowered capacity of crack resistance, the preferably containing quantity of nitrogen is limited in a range of 0.001-0.02 weight percent.

Chromium (Cr): If the containing quantity of chromium is insufficient, that situation lowers the characteristics of corrosion and oxidation resistance at high temperature. On the other hand, if the containing quantity of chromium is too much, the containing quantity of the δ-ferritic stainless steel is increased, and thus resulting in lowering the ability of hot work and the characteristics of formation. Therefore, in order to achieve the objective of getting the capacity of corrosion resistance, getting the capacity of oxidation resistance at high temperature and saving the production cost, the preferably containing quantity of chromium is limited in a range of 14-16 weight percent.

Zinc (Zn): the solubility of zinc in the iron can achieve the range of 0.001-4 weight percent and the reduction potential is −0.763 V which is higher than that of chromium at −0.744 V and of iron at −0.440 V. Thus, zinc is identical to chromium while being applied as the sacrificing material for protecting the ground iron and increasing the capacity of corrosion resistance of iron. Therefore, the preferably containing quantity of zinc is limited in a range of 0.001-4 weight percent.

The second preferred embodiment of the zinc-modified ferritic stainless steel of the present invention and its components comprise carbon in a range of 0.003-0.015 weight percent, nitrogen in a range of 0.001-0.02 weight percent, chromium in a range of 14-16 weight percent, zinc in a range of 0.001-4 weight percent, tin in a range of 0.001-10 weight percent, and the rest of weight percentage of compositions being iron and a few amount of inevitable impurities. The major difference between the second and the first preferred embodiments of the zinc-modified ferritic stainless steel of the present invention is that besides adding zinc in a range of 0.001-4 weight percent, tin is further added in a range of 0.001-10 weight percent. Further analysis and explanation toward the characteristics, containing quantity and importance of each component in the zinc-modified ferritic stainless steel of the first preferred embodiment is as follows.

Carbon (C): carbon is a stable element for strengthening the austenitic stainless steel. Carbon could lower the containing quantity of the δ-ferritic stainless steel and improve the hot workability. In addition, carbon has the effect of reducing the containing quantity of nickel which is expensive, increases the stacking fault energy, and thus improves the characteristic of formation. If the containing quantity of carbon is too much, during the deep-drawing process of stainless steel, the strength of the induced strain of the martensitic stainless steel is increased and the stress strain of the residuals becomes high. Thus, these characteristics result in lowering the capacity of crack resistance. Furthermore, because the $Cr_{23}C_6$ carbide is precipitated to result in lowering the capacity of corrosion resistance when the stainless steel is annealed, the preferably containing quantity of carbon is limited in a range of 0.003-0.015 weight percent.

Nitrogen (N): If the containing quantity of nitrogen is too much and then that situation helps to reduce the containing quantity of the δ-ferritic stainless steel and increases yield strength of the steel, then it deteriorates the characteristics of formation. In addition, because the strength is increased together with lowered capacity of crack resistance, the preferably containing quantity of nitrogen is limited in a range of 0.001-0.02 weight percent.

Chromium (Cr): If the containing quantity of chromium is insufficient, that situation lowers the characteristics of corrosion and oxidation resistance at high temperature. On the other hand, if the containing quantity of chromium is too much, the containing quantity of the δ-ferritic stainless steel is increased, and thus resulting in lowering the ability of hot work and the characteristics of formation. Therefore, in order to achieve the objective of getting the capacity of corrosion resistance, getting the capacity of oxidation resistance at high temperature and saving the production cost, the preferably containing quantity of chromium is limited in a range of 14-16 weight percent.

Zinc (Zn): the solubility of zinc in the iron can achieve the range of 0.001-4 weight percent and the reduction potential is −0.763 V which is higher than that of chromium at −0.744 V and of iron at −0.440 V. Thus, it is identical to chromium while being applied as the sacrificing material for protecting the ground iron and increasing the capacity of corrosion resistance of iron. Therefore, the preferably containing quantity of zinc is limited in a range of 0.001-4 weight percent.

Tin (Sn): the solubility of tin in the iron can achieve the range of 0.001-10 weight percent and the reduction potential is −0.136 V which is lower than that of chromium at −0.744 V and of iron at −0.440 V. Thus, if tin is added into the ground iron, the corrosive potential of iron is increased around 0.1 V and the capacity of corrosion resistance of iron is improved. Therefore, the preferably containing quantity of tin is limited in a range of 0.001-10 weight percent.

In addition, the main effect of developing the alloy with tin is processing an improvement toward the corresponding ferritic stainless steel not containing nickel 430 which is used as the base. Adding a few amount of tin into the stainless steel helps to upgrade the capacity of corrosion resistance of the stainless steel. Conventionally, the iron skin alloyed with tin (so called "tin plate") has a decent capacity of resisting corrosion. The present invention is directly adding tin within a suitable weight percentage into the stainless steel. Thus, the stainless steel not only has a decent capacity of corrosion resistance but also is not extremely fractured. It is noteworthy that the conventional iron skin alloyed with zinc has a nice capacity of corrosion resistance as well. Therefore, the alloying design of the present embodiment is directly adding tin and zinc into the stainless steel not containing nickel 430 in order to get a better capacity of corrosion resistance than the conventional alloying iron skin. Conventionally, the iron skin alloyed with tin (the so called "tin plate") has a nice capacity of corrosion resistance.

The third preferred embodiment of the zinc-modified ferritic stainless steel of the present invention and its components comprise carbon in a range of 0.003-0.015 weight percent, nitrogen in a range of 0.001-0.02 weight percent, chromium in a range of 14-16 weight percent, zinc in a range of 0.001-4 weight percent, tin in a range of 0.001-10 weight percent, copper in a range of 0.001-0.05 weight percent, and the rest of weight percentage of compositions being iron and a few amount of inevitable impurities. The major difference between the third and the second preferred embodiments of the zinc-modified ferritic stainless steel of the present invention is that besides adding tin in a range of 0.001-10 weight percent, copper is further added in a range of 0.001-0.05 weight percent. Further analysis and explanation toward the characteristics, containing quantity and importance of each component in the zinc-modified ferritic stainless steel of the first preferred embodiment is as follows.

Carbon (C): carbon is a stable element for strengthening the austenitic stainless steel. Carbon could lower the containing quantity of the δ-ferritic stainless steel and improve the ability of hot work. In addition, carbon has the effect of reducing the containing quantity of nickel which is expensive, increases the stacking fault energy, and thus improves the characteristic of formation. If the containing quantity of carbon is too much, during the deep-drawing process of stainless steel, the strength of the induced strain of the martensitic stainless steel is increased and the stress strain of the residuals becomes high. Thus, these characteristics result in lowering the capacity of crack resistance. Furthermore, because the $Cr_{23}C_6$ carbide is precipitated to result in lowering the capacity of corrosion resistance when the stainless steel is annealed, the preferably containing quantity of carbon is limited in a range of 0.003-0.015 weight percent.

Nitrogen (N): If the containing quantity of nitrogen is too much and then that situation helps to reduce the containing quantity of the δ-ferritic stainless steel and increases the yield strength of the steel, then it deteriorates the characteristics of formation. In addition, because the strength is increased together with lowered capacity of crack resistance, the preferably containing quantity of nitrogen is limited in a range of 0.001-0.02 weight percent.

Chromium (Cr): If the containing quantity of chromium is insufficient, that situation lowers the characteristics of corrosion and oxidation resistance at high temperature. On the other hand, if the containing quantity of chromium is too much, the containing quantity of the δ-ferritic stainless steel is increased, and thus resulting in lowering the ability of hot work and the characteristics of formation. Therefore, in order to achieve the objective of getting the capacity of corrosion resistance, getting the capacity of oxidation resistance at high temperature and saving the production cost, the preferably containing quantity of chromium is limited in a range of 14-16 weight percent.

Zinc (Zn): the solubility of zinc in the iron can achieve the range of 0.001-4 weight percent and the reduction potential is −0.763 V which is lower than that of chromium at −0.744 V and of iron at −0.440 V. Thus, it is identical to chromium while being applied as the sacrificing material for protecting the ground iron and increasing the capacity of corrosion resistance of iron. Therefore, the preferably containing quantity of zinc is limited in a range of 0.001-4 weight percent.

Tin (Sn): the solubility of tin in the iron can achieve the range of 0.001-10 weight percent and the reduction potential is −0.136 V which is lower than that of chromium at −0.744 V and of iron at −0.440 V. Thus, if tin is added into the ground iron, the corrosive potential of iron is increased around 0.1 V and the capacity of corrosion resistance of iron is improved. Therefore, the preferably containing quantity of tin is limited in a range of 0.001-10 weight percent.

Copper (Cu): the existence of copper can soften the steel, increase the stacking fault energy, and improve the stability of the austenitic stainless steel. Therefore, copper can replace nickel. In addition, the addition of copper also helps the capacity of mold operation of the stainless steel. However, if the containing quantity of copper exceeds 1 weight percent, the characteristic of formation of the stainless steel is lowered and the copper with low melting point is precipitated when the steel material is casting. The hot shortness is generated when the stainless steel is hot rolling. Therefore, the preferably containing quantity of copper is limited in a range of 0.001-0.05 weight percent.

The preferred embodiment:

In order for zinc to successfully dissolve in the zinc-modified ferritic stainless steel (later, called as chromium, tin and zinc alloy), CSZ1403, CSZ1433, CSZ1603 and CSZ1633, containing zinc among the chromium, tin and zinc alloy all use the mechanical alloying to manufacture via the alloyed powder. The experimental method is utilizing the designed components of the chromium, tin and zinc alloy in Table 1 to manufacture the powder of weight of 40 grams.

TABLE 1 the table of designed components of the chromium, tin and zinc alloy by mechanical alloying

| CSZ Code (Weight percent, wt %) | Cr | Mn | Si | Zn | Sn | Fe |
|---|---|---|---|---|---|---|
| 1403 | 14 | 0.1 | 0.12 | 0.3 | — | 85.48 |
| 1433 | 14 | 0.1 | 0.12 | 0.3 | 0.3 | 85.18 |
| 1603 | 16 | 0.1 | 0.12 | 0.3 | — | 83.48 |
| 1633 | 16 | 0.1 | 0.12 | 0.3 | 0.3 | 83.18 |

In order to prevent the pollution resulting from the collision and falling of milling balls, the chromium ball coded AISI 52100 is selected by the manufacturer to perform the ball milling. After putting 125 grams of chromium balls and 40 grams of powder into the ball milling can, the can is sealed under the condition of surrounding Argon (Ar) gas to avoid the components from being oxidized during the ball milling process. After accomplishing the manufacture, the manufacturer can put the components into the ball milling machine to stir for 10 hours and then take the powders out. FIG. 1 shows the obtained results of XRD analysis toward the powders generated from the chromium, tin and zinc alloy containing zinc after performing the ball milling. As compared to the peak of the pure iron alloyed with chromium after the ball milling, it can be observed that not only the intensity of the peak of the chromium, tin and zinc alloy decreases, but also the peak slightly shifts to the left. Because different radii of atoms performing the solid solution treatment would destroy the beneficial interference of X-ray, the peak of diffraction decreases. According to the Bragg diffraction formula: $2d \sin \theta = n\lambda$, wherein d is the constant of the planar crystal between atoms, $\theta$ is a diffraction angle, and $\lambda$ is the wavelength of the injecting X-ray. Because the atomic radii of tin and zinc are larger than those of iron and chromium, when the atom with large radius adds to form solid solution in the iron and chromium alloy, the constant of the planar distance between atoms would increase so that the peak of diffraction shifts to the small $2\theta$ angle. Therefore, it is concluded that tin and zinc form a solid solution in the iron and chromium alloy through the mechanical milling of the alloy. Table 2 shows the analytic results by using inductively coupled plasma-mass spectrometry (ICP-MS).

TABLE 2 the table of components of the chromium, tin and zinc alloy by mechanical alloying through ICP-MS

| CSZ Code (Weight percent, wt %) | Cr | Zn | Sn | Fe |
|---|---|---|---|---|
| 1403 | 12.7 | 0.254 | — | 82.7 |
| 1433 | 13.1 | 0.278 | 0.307 | 83.2 |
| 1603 | 14.5 | 0.286 | — | 81.6 |
| 1633 | 15.4 | 0.273 | 0.311 | 81.4 |

In addition, in another preferred embodiment, after analyzing the chromium, tin and zinc alloy through applying XRD (with reference to FIG. 1), it is obvious that the chromium, tin and zinc alloy belongs to the structure of BCC. Because the chromium, tin and zinc alloy is made by processing an improvement toward the ferritic stainless steel 430, which is used as the base, the main structure of the alloy is roughly identical to that of the stainless steel 430. It is noteworthy that the peaks of the CSZ1430 alloy and the CSZ1630 alloy shift to the left, and with the containing quantities of chromium and tin increasing, the peak obviously becomes less sharp and the intensity lowers a lot. This result shows tin successfully performs a solid solution former in the iron and chromium alloy. The photograph of BEI shows approximately the same conclusion as XRD. Because the chromium, tin and zinc alloy uses the ferritic stainless steel 430 as the base, it forms a structure of single phase after being homogenized.

In addition, the analysis toward the components through EDS proves tin performs a solid solution former in the iron and chromium alloy.

TABLE 3 table of the analysis toward the components of the chromium, tin and zincalloy through EDS

| CSZ Code (Weight percent, wt %) | Cr | Mn | Si | Zn | Sn | Fe |
|---|---|---|---|---|---|---|
| 1400 | 14.23 | 0.13 | 0.26 | — | — | 85.38 |
| 1430 | 14.04 | 0.17 | 0.12 | — | 0.22 | 85.45 |
| 1600 | 15.83 | 0.21 | 0.07 | — | — | 83.89 |
| 1630 | 16.17 | 0.15 | 0.26 | — | 0.47 | 82.95 |

It is noteworthy that the characteristic of corrosion of the powder of the chromium, tin and zinc alloy in the ball milling process could not be directly measured, and it remains unable to afford the pressure from the clip of the electrochemical instrument after processing a treatment of low temperature together with high pressure. Therefore, it can be formed as a blocking metal through sintering. In order to prevent the powder of the iron, chromium and zinc alloy directly sintered in the air from generating a problem of vaporization, a furnace tube with the gas passing through is used for sintering. The flow is: putting the test piece into a mould after processing the cold briquetting process under the pressure of 70 MPa, wherein the preferably predetermined condition of the mould is the metal that affords high temperature around 900° C., not being oxidized easily, and the strength of it is not changed under the condition of high temperature. Then, putting the mould into a furnace tube via pressurizing and sealing the furnace tube, and then withdrawing the air inside the furnace tube by using the mechanical pump for 0.5 hour to make it vacuumed; then injecting nitrogen for 0.5 hour to make it under the condition of positive pressure for ensuring the inner of the furnace tube without oxygen, then heating the furnace tube to increase the temperature to 700° C. within an hour and maintaining it under the temperature of 700° C. for 12 hours; finally, taking the test piece out and then performing a water quenching treatment. The main reason of using special mould to perform the fixed pressurization and the water quenching treatments is that when using the method of cooling via furnace in prior art, the observer finds that the test piece is easily broken, bent or deformed so that the test piece taken out is too fragile to proceeding any measurement. Specifically, there are two main reasons for occurring the deformation and the embrittlement: one is liquid-metal embrittlement (LME), and the other is the evaporation of zinc.

When a ductile metal under normal conditions contacts the metal with low melting point, and the temperature is around the melting point of the metal with a low melting point, because the strength of the metal with low melting point is substantially decreased and resulting in the ductile metal a huge stress. The phenomenon resulting in both the strength and the ductility of the metal extremely being lowered is called liquid-metal embrittlement (LME). The phenomenon of embrittlement that the test piece is fractured results from merely adding a tiny amount of metal with low melting point. Because the melting points of tin and zinc are far lower than those of iron and chromium, when the temperature of the furnace cools down around 400° C., which equals to the melting point of zinc, the test piece is easily fractured. Therefore, the method of cooling is changed from that used in manufacture as water quenching to get rid of the interval of melting point of zinc. When sintering without using mould to perform pressurization, the test piece is generally produced with bumpy conditions on it. Therefore, manufacturer can use the fixed pressurization mould to avoid the test piece from fracturing and distortion.

By the way, comparing the reduction potentials of tin, zinc, chromium and iron with each other, the conclusion is made in the following: the activity of tin is smaller than that of iron and chromium. Thus, when it is soaked in the corrosive solution, the corrosion of the iron and chromium alloy accelerates. Because the containing quantity of the additive is few, the degree of acceleration is not destroying dissolution and so that the passivation chromium film thickens. However, the activity of zinc is larger than that of iron and chromium, then the method of tiny addition inhibits the corrosive reaction of the whole chromium, and thus resulting in difficulty in formation of the chromium film; and the dissolved zinc compounds due to the corrosive reaction do not have any protective effect more possibly. Therefore, the phenomenon of passivation would not take place.

In summary about the description above, the zinc-modified ferritic stainless steel of the present invention includes the advantage as follows:

Through adding zinc which has high capacity of corrosion resistance instead of the elements such as nickel, manganese, and so on having not only high capacity of corrosion resistance but also high price to the manufacture of the austenitic stainless steels with high capacity of corrosion resistance in prior art, the production cost of the stainless steel with high capacity of corrosion resistance may be efficiently reduced.

While the means of specific embodiments in the present invention has been described by reference drawings, numerous modifications and variations could be made thereto by those skilled in the art without departing from the scope and spirit of the invention set forth in the claims. The modifications and variations should in a range limited by the specification of the present invention.

What is claimed is:

1. A manufacturing method of zinc-modified ferritic stainless steels, comprising the following steps of:

providing a test piece and proceeding a cold briquetting process;

putting the test piece into a mould after proceeding the cold briquetting process;

putting the mould into a furnace tube and then heating the furnace tube to keep the furnace tube maintaining a predetermined temperature within a predetermined time; and taking the test piece out from the mould and then performing a water quenching process to get the zinc-modified ferritic stainless steels;

wherein oxygen does not exist in the furnace tube during heating process;

wherein the compositions of the test piece comprise carbon, nitrogen, chromium, and zinc to form the zinc-modified ferritic stainless steels, in which carbon is in a range of 0.003-0.015 weight percent, nitrogen is in a range of 0.001-0.02 weight percent, chromium is in a range of 14-16 weight percent, zinc is in a range of 0.001-4 weight percent, and rest of weight percentage of compositions is iron.

2. The manufacturing method of claim 1, wherein the predetermined temperature is in a range of 600° C. to 800° C.

3. The manufacturing method of claim 1, wherein the predetermined time is in a range of 10 hours to 14 hours.

4. The manufacturing method of claim 1, wherein the mould is designed to make zinc inside the test piece nonvolatile in order to improve recovery ratio of metal.

5. A manufacturing method of zinc-modified ferritic stainless steels, comprising the following steps of:

providing a test piece and proceeding a cold briquetting process;

putting the test piece into a mould after proceeding the cold briquetting process;

putting the mould into a furnace tube and then heating the furnace tube to keep the furnace tube maintaining a predetermined temperature within a predetermined time; and taking the test piece out from the mould and then performing a water quenching process to get the zinc-modified ferritic stainless steels;

wherein oxygen does not exist in the furnace tube during heating process;

wherein the compositions of the test piece comprise carbon, nitrogen, chromium, zinc, and tin to form the zinc-modified ferritic stainless steels, in which carbon is in a range of 0.003-0.015 weight percent, nitrogen is in a range of 0.001-0.02 weight percent, chromium is in a range of 14-16 weight percent, zinc is in a range of 0.001-4 weight percent, tin is in a range of 0.001-10 weight percent, and rest of weight parentage of compositions is iron.

6. The manufacturing method of claim 5, wherein the predetermined temperature is in a range of 600° C. to 800° C.

7. The manufacturing method of claim 5, wherein the predetermined time is in a range of 10 hours to 14 hours.

8. The manufacturing method of claim 5, wherein the mould is designed to make zinc inside the test piece nonvolatile in order to improve recovery ratio of metal.

9. A manufacturing method of zinc-modified ferritic stainless steels, comprising the following steps of:

providing a test piece and proceeding a cold briquetting process;

putting the test piece into a mould after proceeding the cold briquetting process;

putting the mould into a furnace tube and then heating the furnace tube to keep the furnace tube maintaining a predetermined temperature within a predetermined time; and taking the test piece out from the mould and then performing a water quenching process to get the zinc-modified ferritic stainless steels;

wherein oxygen does not exist in the furnace tube during heating process;

wherein the compositions of the test piece comprise carbon, nitrogen, chromium, zinc, tin and copper to form the zinc-modified ferritic stainless steels, in which carbon is in a range of 0.003-0.015 weight percent, nitrogen is in a range of 0.001-0.02 weight percent, chromium is in a range of 14-16 weight percent, zinc is in a range of 0.001-4 weight percent, tin is in a range of 0.001-10 weight percent, copper is in a range of 0.001-0.05 weight percent, and rest of weight percentage of compositions is iron.

10. The manufacturing method of claim 9, wherein the predetermined temperature is in a range of 600° C. to 800° C.

11. The manufacturing method of claim 9, wherein the predetermined time is in a range of 10 hours to 14 hours.

12. The manufacturing method of claim 9, wherein the mould is designed to make zinc inside the test piece nonvolatile in order to improve recovery ratio of metal.

* * * * *